US010597810B2

(12) United States Patent
Nam et al.

(10) Patent No.: US 10,597,810 B2
(45) Date of Patent: Mar. 24, 2020

(54) LAUNDRY TREATMENT APPARATUS

(71) Applicant: LG Electronics Inc., Seoul (KR)

(72) Inventors: Hyunsu Nam, Seoul (KR); Incheol Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 259 days.

(21) Appl. No.: 15/858,271

(22) Filed: Dec. 29, 2017

(65) Prior Publication Data

US 2018/0209086 A1 Jul. 26, 2018

(30) Foreign Application Priority Data

Jan. 24, 2017 (KR) ..... 10-2017-0010919

(51) Int. Cl.

| | |
|---|---|
| ***D06F 37/24*** | (2006.01) |
| ***D06F 58/06*** | (2006.01) |
| ***D06F 21/02*** | (2006.01) |
| ***D06F 37/04*** | (2006.01) |
| ***D06F 37/20*** | (2006.01) |
| *D06F 58/08* | (2006.01) |
| *D06F 58/20* | (2006.01) |

(52) U.S. Cl.

CPC ..... *D06F 37/24* (2013.01); *D06F 21/02* (2013.01); *D06F 37/04* (2013.01); *D06F 37/206* (2013.01); *D06F 58/06* (2013.01); *D06F 58/08* (2013.01); *D06F 58/20* (2013.01)

(58) Field of Classification Search

CPC ..... D06F 37/24

See application file for complete search history.

(56) References Cited

U.S. PATENT DOCUMENTS

| | | | |
|---|---|---|---|
| 6,474,112 | B1 | 11/2002 | Han et al. |
| 2009/0158616 | A1 | 6/2009 | Ricklefs et al. |

FOREIGN PATENT DOCUMENTS

| | | |
|---|---|---|
| EP | 0404252 | 12/1990 |
| KR | 10-2005-0037186 | 4/2005 |
| KR | 10-2005-0119261 | 12/2005 |
| WO | WO2013122422 | 8/2013 |

OTHER PUBLICATIONS

Office Action in Australian Application No. 2017279768, dated Nov. 16, 2018, 4 pages.

European Extended Search Report in European Application No. 18152906.6, dated May 30, 2018, 6 pages.

*Primary Examiner* — Jason Y Ko

(74) *Attorney, Agent, or Firm* — Fish & Richardson P.C.

(57) ABSTRACT

A laundry treatment apparatus is disclosed. The laundry treatment apparatus includes a cabinet, a drum having a cylindrical shape, a first support member to rotatably support an open front drum surface, an opening formed through the first support member to allow the drum to communicate with a cabinet opening, a second support member to rotatably support an open rear drum surface, a driving unit to rotate the drum, a first mounting portion provided at a selected one of the support members and disposed below a horizontal line passing through a rotation center of the drum, a second mounting portion provided at the selected support member and disposed above the horizontal line, and a drum support unit configured to rotatably support a circumferential surface of the drum and to be separably coupled to either the first mounting portion or the second mounting portion in an interchangeable manner.

20 Claims, 4 Drawing Sheets

LAUNDRY TREATMENT APPARATUS

This application claims the benefit of Korean Patent Application No. 10-2017-0010919, filed on Jan. 24, 2017, which is hereby incorporated by reference as if fully set forth herein.

BACKGROUND OF THE INVENTION

Field of the Invention

The present invention relates to a laundry treatment apparatus.

Discussion of the Related Art

Generally, a laundry treatment apparatus is a generic term encompassing a washing machine configured to separate foreign matter from laundry using water and a drying machine configured to remove moisture from laundry. There is a conventional laundry treatment apparatus including a cabinet, a drum rotatably installed in the cabinet and configured to provide a space for storing laundry, a belt connecting a circumferential surface of the drum to a rotational shaft of a motor, and rollers configured to rotatably support a lower region of the circumferential surface of the drum.

The conventional laundry treatment apparatus having the above-mentioned configuration may have a problem in that, when a user uses the laundry treatment apparatus with the cabinet upside down, the belt may exhibit degraded durability because the rollers cannot support the drum. A user may use two laundry treatment apparatuses in a state in which one laundry treatment apparatus is seated on the other laundry treatment apparatus. In this case, the upper laundry treatment apparatus may be seated upside down on a top surface of the lower laundry treatment apparatus. When the upper laundry treatment apparatus is used while upside down, as mentioned above, input of control commands may be conveniently conducted because a control panel equipped in the upper laundry treatment apparatus is disposed at the top of the cabinet of the upper laundry treatment apparatus.

However, when the upper laundry treatment apparatus is used while upside down, the rollers thereof cannot support the associated drum. As a result, there may be a problem in that the drum cannot stably rotate. In addition, when the drum cannot be supported by the rollers, there may be a problem in that durability of the belt may be degraded because the weight of the drum is concentrated on the belt.

SUMMARY OF THE INVENTION

Accordingly, the present invention is directed to a laundry treatment apparatus that substantially obviates one or more problems due to limitations and disadvantages of the related art.

An object of the present invention is to provide a laundry treatment apparatus capable of changing positions of rollers configured to rotatably support a drum.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treatment apparatus includes a cabinet provided with a cabinet opening for loading and unloading of laundry, a drum installed in the cabinet, the drum having a cylindrical shape open at a front drum surface disposed toward the cabinet opening and at a rear drum surface disposed opposite to the front drum surface, a first support member installed in the cabinet and configured to rotatably support the front drum surface, an opening formed through the first support member and configured to allow the drum to communicate with the cabinet opening, a second support member installed in the cabinet and configured to rotatably support the rear drum surface, a driving unit configured to rotate the drum, a first mounting portion provided at a selected one of the first and second support members and disposed in a space defined below a horizontal line passing through a rotation center of the drum, a second mounting portion provided at the selected support member provided with the first mounting portion and disposed in a space defined above the horizontal line passing through the rotation center of the drum, and a drum support unit configured to rotatably support a circumferential surface of the drum and to be separably coupled to either the first mounting portion or the second mounting portion in an interchangeable manner.

The cabinet may include a body having an open front surface, and a front panel detachably attached to the front surface of the body and formed with the cabinet opening. The first mounting portion and the second mounting portion may be provided at the first support member.

The first mounting portion may include a first lower through hole formed through the first support member. The second mounting portion may include a first upper through hole formed through the first support member. The drum support unit may include first shafts respectively fittable in the first lower through hole and the first upper through hole, and first rollers rotatably coupled to respective first shafts and configured to contact the circumferential surface of the drum.

The first mounting portion may include a first lower through hole formed through the first support member, and a second lower through hole formed through the first support member. The second mounting portion may include a first upper through hole formed through the first support member, and a second upper through hole formed through the first support member. The drum support unit may include first shafts respectively fittable in the first lower through hole and the first upper through hole, second shafts respectively fittable in the second lower through hole and the second upper through hole, first rollers rotatably coupled to respective first shafts and configured to contact the circumferential surface of the drum, and second rollers rotatably coupled to respective second shafts and configured to contact the circumferential surface of the drum.

Positions of the first and second upper through holes may be determined such that the first and second rollers are disposed at two corners formed at an upper space of the body, respectively.

Positions of the first and second lower through holes may be determined such that at least one of the first and second rollers is disposed at a corner formed at a lower space of the body.

Each of the first shafts may include a first shaft body having a first roller coupling portion coupled to a rotation center of an associated one of the first rollers, and a first fastening portion configured to allow a nut to be fastened thereto, and a first rotation preventing portion disposed between the first roller coupling portion and the first fastening portion and configured to have a polygonal cross-section. Each of the second shafts may include a second shaft body having a second roller coupling portion coupled to a rotation center of an associated one of the second rollers, and a second fastening portion configured to allow a nut to be fastened thereto, and a second rotation preventing portion disposed between the second roller coupling portion and the second fastening portion and configured to have the same cross-sectional shape as the first rotation preventing portion. The first lower through hole, the second lower through hole, the first upper through hole and the second upper through hole may have the same cross-sectional shape as the first rotation preventing portion.

The driving unit may include a motor having a rotational shaft, and a belt configured to connect the circumferential surface of the drum to the rotational shaft and installed such that tensile force applied to the drum by the belt is directed to a space defined between the first lower through hole and the second lower through hole.

The cabinet may include a body having an open rear surface and an open front surface formed with the cabinet opening, and a rear panel detachably attached to the rear surface. The first mounting portion and the second mounting portion may be provided at the second support member.

The first mounting portion may include a first lower through hole formed through the second support member, and a second lower through hole formed through the second support member. The second mounting portion may include a first upper through hole formed through the second support member, and a second upper through hole formed through the second support member. The drum support unit may include first shafts respectively fittable in the first lower through hole and the first upper through hole, second shafts respectively fittable in the second lower through hole and the second upper through hole, first rollers rotatably coupled to respective first shafts and configured to contact the circumferential surface of the drum, and second rollers rotatably coupled to respective second shafts and configured to contact the circumferential surface of the drum.

Each of the first shafts may include a first shaft body having a first roller coupling portion coupled to a rotation center of an associated one of the first rollers, and a first fastening portion configured to allow a nut to be fastened thereto, and a first rotation preventing portion disposed between the first roller coupling portion and the first fastening portion and configured to have a polygonal cross-section. Each of the second shafts may include a second shaft body having a second roller coupling portion coupled to a rotation center of an associated one of the second rollers, and a second fastening portion configured to allow a nut to be fastened thereto, and a second rotation preventing portion disposed between the second roller coupling portion and the second fastening portion and configured to have the same cross-sectional shape as the first rotation preventing portion. The first lower through hole, the second lower through hole, the first upper through hole and the second upper through hole may have the same cross-sectional shape as the first rotation preventing portion.

The driving unit may include a motor having a rotational shaft, and a belt configured to connect the circumferential surface of the drum to the rotational shaft and installed such that tensile force applied to the drum by the belt is directed to a space defined between the first lower through hole and the second lower through hole.

In another aspect of the present invention, a laundry treatment apparatus includes a cabinet including a body having an open front surface, and a front panel detachably attached to the front surface, a cabinet opening formed through the front panel, a drum installed in the cabinet, the drum having a cylindrical shape open at a front drum surface disposed toward the cabinet opening and at a rear drum surface disposed opposite to the front drum surface, a first support member installed in the cabinet and configured to rotatably support the front drum surface, an opening formed through the first support member and configured to allow the drum to communicate with the cabinet opening, a second support member installed in the cabinet and configured to rotatably support the rear drum surface, a first mounting portion provided at the first support member and disposed in a space defined below a horizontal line passing through a rotation center of the drum, a second mounting portion provided at the first support member and disposed in a space defined above the horizontal line passing through the rotation center of the drum, and a drum support unit configured to rotatably support a circumferential surface of the drum and to be separably coupled to either the first mounting portion or the second mounting portion in an interchangeable manner.

In another aspect of the present invention, a laundry treatment apparatus includes a cabinet including a body having an open rear surface, and a rear panel detachably attached to the rear surface, a cabinet opening formed through the body, a drum installed in the cabinet, the drum having a cylindrical shape open at a front drum surface disposed toward the cabinet opening and at a rear drum surface disposed toward the rear panel, a first support member installed in the cabinet and configured to rotatably support the front drum surface, an opening formed through the first support member and configured to allow the drum to communicate with the cabinet opening, a second support member installed in the cabinet and configured to rotatably support the rear drum surface, a first mounting portion provided at the second support member and disposed in a space defined below a horizontal line passing through a rotation center of the drum, a second mounting portion provided at the second support member and disposed in a space defined above the horizontal line passing through the rotation center of the drum, and a drum support unit configured to rotatably support a circumferential surface of the drum and to be separably coupled to either the first mounting portion or the second mounting portion in an interchangeable manner.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
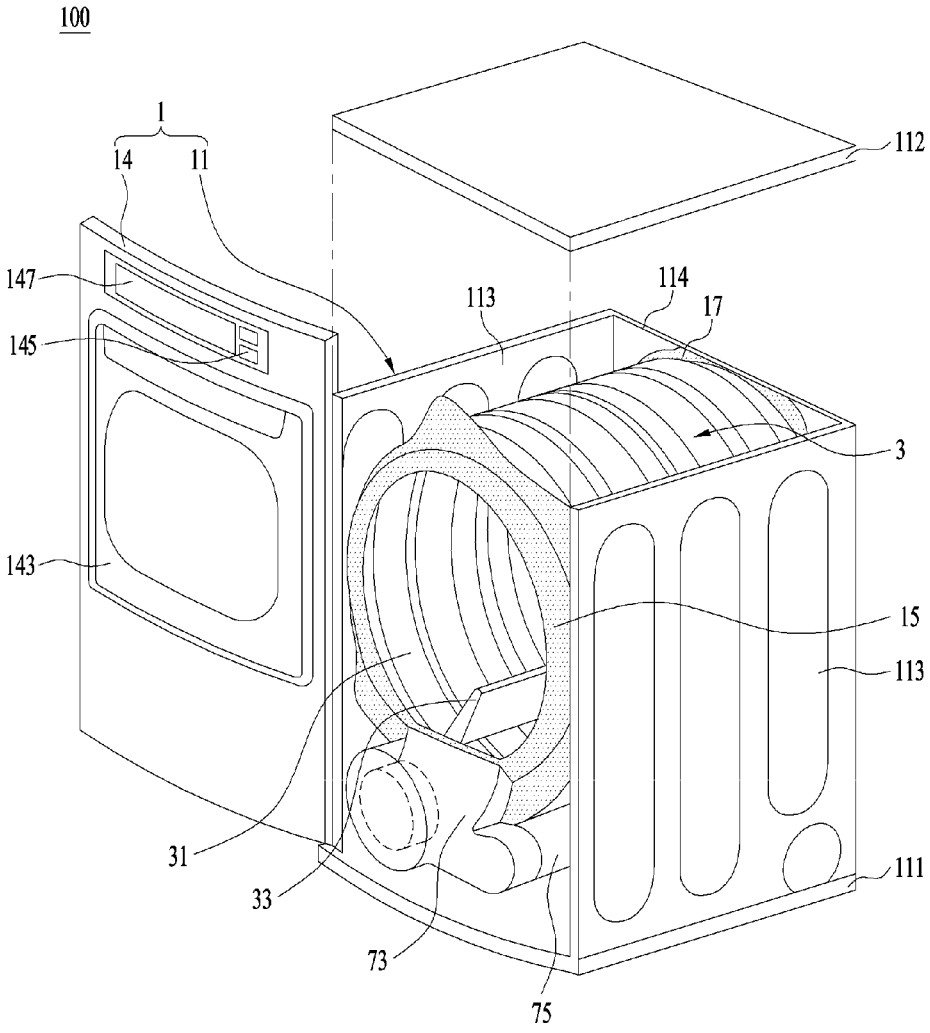
FIGS. 1 and 2 are views illustrating an example of a laundry treatment apparatus according to an embodiment of the present invention.

Reference will now be made in detail to the preferred embodiments of the present invention, examples of which are illustrated in the accompanying drawings. Meanwhile, the configuration or control method of an apparatus disclosed herein is illustrated only to explain embodiments of the present invention, and shall not be construed as limiting the scope of the present invention. In addition, the same reference numerals will be used throughout the specification to refer to the same parts.

FIG. 1 illustrates a laundry treatment apparatus 100 according to an embodiment of the present invention. The laundry treatment apparatus 100 may include a cabinet 1, a drum 3 rotatably installed in the cabinet 1 and configured to provide a space for storing laundry, and a hot air supplier 7 configured to supply heated air (hot air) to the drum 3.

The cabinet 1 may include a body 11 having an open front surface, and a front panel 14 detachably attached to the front surface of the body 11. The body 11 includes a base 111 configured to define a bottom surface of the laundry treatment apparatus, a top panel 112 configured to define a top surface of the laundry treatment apparatus, a rear panel 114 configured to define a rear surface of the laundry treatment apparatus, and side panels 113 configured to define side surfaces of the laundry treatment apparatus.

The body 11 may have an integrated structure of the base 111, top panel 112, rear panel 114 and side panels 113. Alternatively, the body 11 may have an integrated structure of the side panels 113 and the rear panel 114. In this case, the top panel 112 and the base 111 are assembled into the integrated structure of the side panels 113 and rear panel 114. Cabinet through holes 115 may be formed through the rear panel 114.

Figure 2:
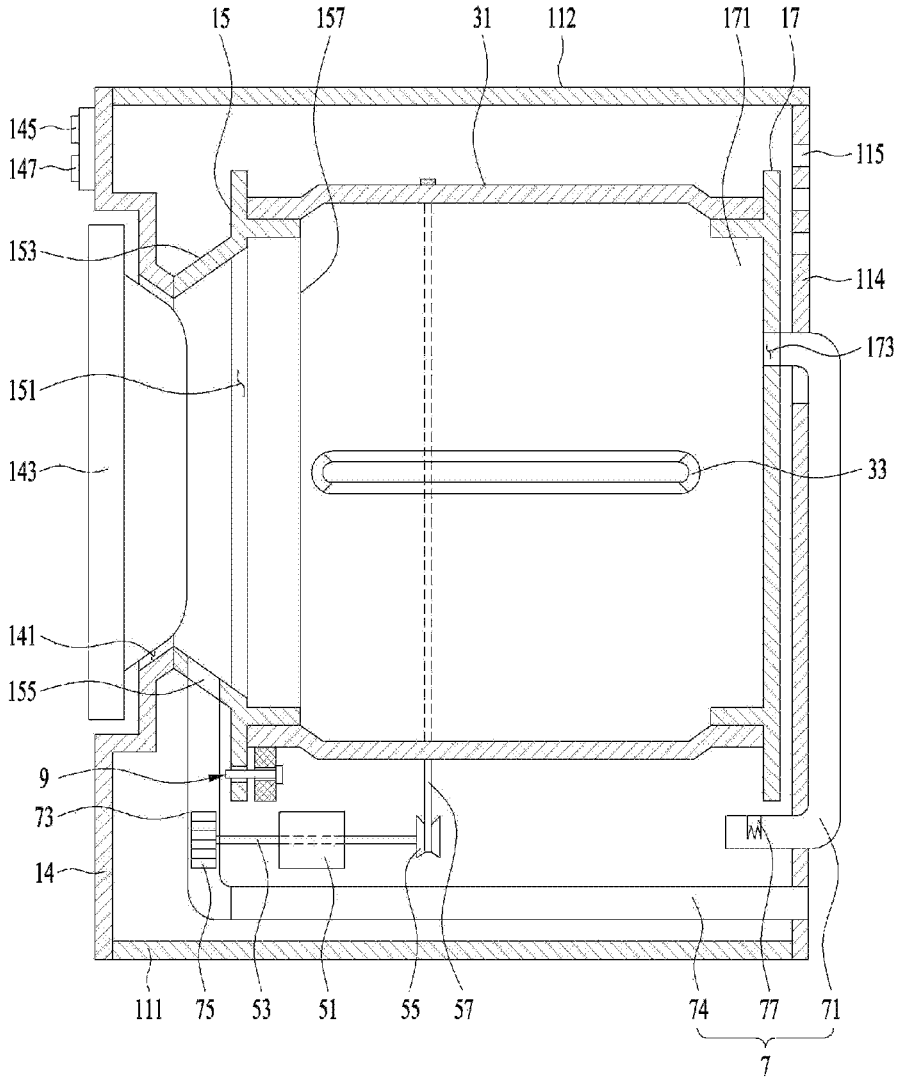

As illustrated in FIG. 2, a cabinet opening 141 is provided at the front panel 14. The cabinet opening 141 allows the interior of the body 11 to communicate with the exterior of the body 11. The cabinet opening 141 may be opened or closed by a door 143 rotatably coupled to the front panel 14.

The front panel 14 is provided with an input unit 145 configured to allow the user to input a control command to a controller (not shown) therethrough, and a display unit 147 configured to display control commands selectable by the user or execution information of a control command selected by the user. The input unit 14 and the display unit 147 may be provided at an area provided by the front panel 14 and disposed above the door 143.

The drum 3 may include a cylindrical drum body 31 open at a front drum surface directed toward the cabinet opening 141 and a rear drum surface directed toward the rear panel 114 (opposite to the front drum surface).

In this case, the cabinet 1 may be provided therein with a first support member 15 configured to rotatably support the front drum surface, and a second support member 17 configured to rotatably support the rear drum surface.

The first support member 15 includes a first support body fixed to the inside of the cabinet 1, an opening 151 formed through the first support body and configured to communicate with the cabinet opening 141, and a front surface support portion 157 protruding from the first support body toward the drum body 31 so as to be fitted in an opening formed through the front drum surface. The front surface support portion 157 may be configured to surround the opening 151.

In addition, the first support member 15 may be connected to the cabinet opening 141 through a connecting portion 153 protruding from the first support body toward the front panel 14. The connecting portion 153 may be configured to surround the opening 151.

The second support member 17 includes a second support body fixed to the inside of the cabinet 1, and a rear surface support portion 171 protruding from the second support body toward the drum body 31 so as to be fitted in an opening formed through the rear drum surface.

The drum 3 may further include a lifter 33 protruding from a circumferential surface of the drum body 31 toward a rotation center of the drum body 31 at the inside of the drum body 31. The lifter 35 is configured to move laundry within the drum body 31 during rotation of the drum body 31 so as to promote heat exchange between the laundry and hot air supplied by the hot air supplier 7.

The drum body 31 is rotated by a driving unit 5 installed within the cabinet 1. The driving unit 5 may include a motor 51 having a rotational shaft 53, and a belt connecting the circumferential surface of the drum body 31 to the rotational shaft 53. The motor 51 may be installed in a space defined between the drum body 31 and the base 11. The motor 51 may further have a pulley 55 mounted to the rotational shaft 53 and configured to support the belt 57.

The hot air supplier 7 may include a supply duct 71 configured to supply ambient air to the drum 3, a first exhaust duct 73 provided with an impeller 75 configured to discharge air present at the inside of the drum 3 to the outside of the drum 3, and a second exhaust duct 74 configured to guide air discharged from the first exhaust duct 73 to the outside of the cabinet 1. The hot air supplier 7 may further include a heater 77 configured to heat air introduced into the supply duct 71.

The second support portion 17 is provided with a supply port 173 formed through the second support body. The supply duct 71 is connected to the supply port 173 and, as such, supplies ambient air to the drum 3.

Meanwhile, the first support portion 15 is provided with an exhaust port 155 formed through the connecting portion 153. The first exhaust duct 73 is connected to the exhaust port 155.

The impeller 75 is rotatably installed within the first exhaust duct 73. The impeller 75 may be configured to be rotated by a separate fan motor. Alternatively, the impeller 75 may be configured to be rotated by the motor 51 of the driving unit, as illustrated in FIG. 2. In the latter case, the impeller 75 may be fixed to one end of the rotational shaft 53, and the pulley 55 may be fixed to the other end of the rotational shaft 53.

When the impeller 75 rotates, air present at the inside of the drum body 31 moves to the outside of the cabinet 1 through the first and second exhaust ducts 73 and 74. When air present at the inside of the drum body 31 is discharged to the outside of the cabinet 1, air present at the inside of the cabinet 1 is supplied to the drum body 31 through the supply duct 71. Air moving to the drum body 31 through the supply duct 71 is heated while passing around the heater 77 and, as such, the hot air supplier 7 may supply hot air to laundry.

Figure 3:
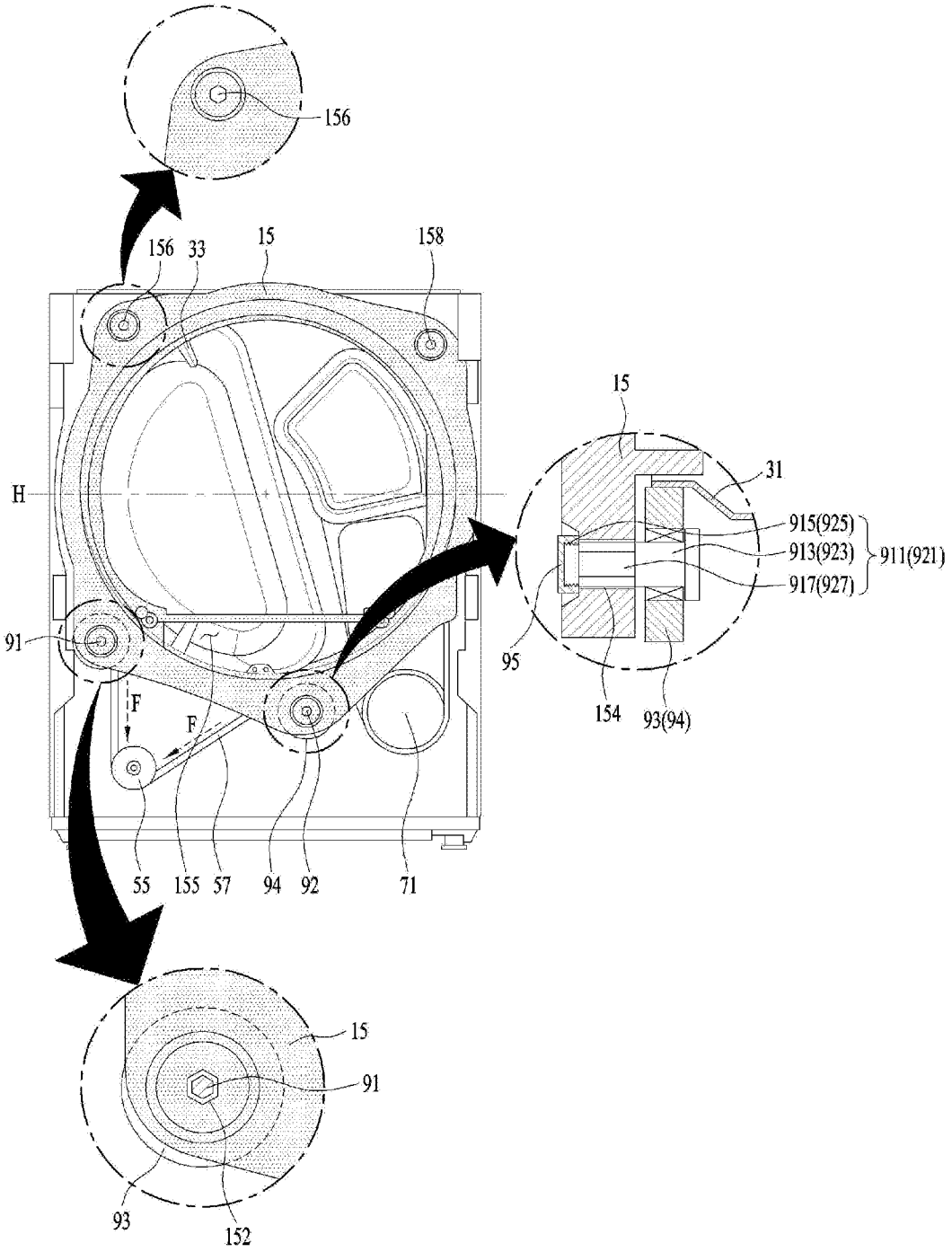
FIG. 3 is a view illustrating an example of a drum support unit provided at the laundry treatment apparatus according to the embodiment of the present invention.
Figure 4:
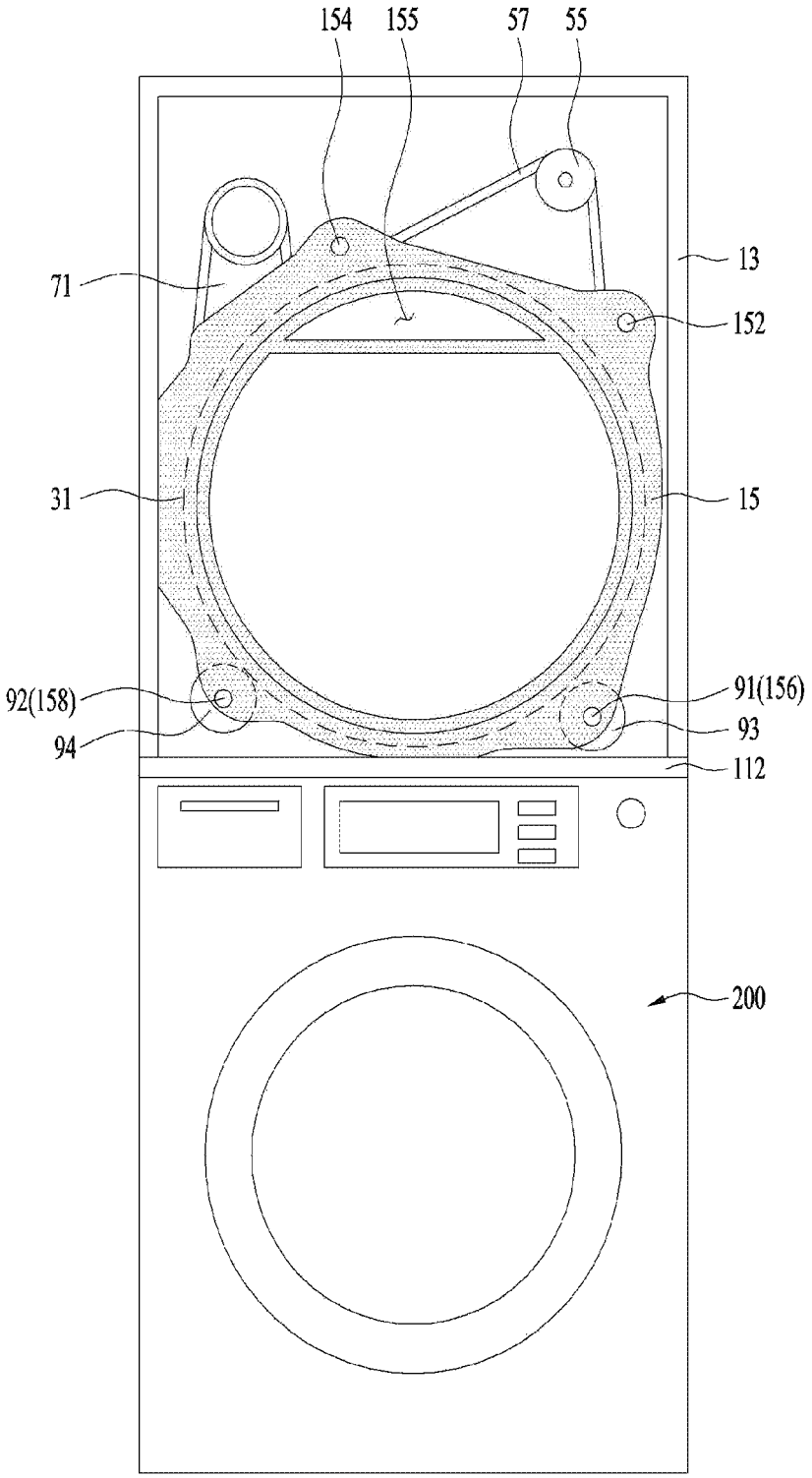
FIG. 4 is a view illustrating an example in which the laundry treatment apparatus according to the embodiment of the present invention is used while upside down.

Meanwhile, the laundry treatment apparatus 100 having the above-described configuration may further include a drum support unit 9 configured to rotatably support the circumferential surface of the drum body 31. As illustrated in FIGS. 3 and 4, the drum support unit 9 has a feature in that the drum support unit 9 can be separably coupled to either a first mounting portion provided at the first support member 15 or a second mounting portion provided at the first support member 15 in an interchangeable manner.

As illustrated in FIG. 3, the first mounting portion may have a structure including at least one through hole provided at a space defined by the first support member 15 and disposed below a horizontal line H passing through the rotation center of the drum body 31. That is, the first mounting portion may include a first lower through hole 152 alone. In this case, the first lower through hole 152 is formed through the first support member 15. Alternatively, the first mounting portion may include a second lower through hole 154 formed through the first support member 15 in addition to the first lower through hole 152.

The second mounting portion may have a structure including at least one through hole provided at a space defined by the first support member 15 and disposed above the horizontal line H. That is, the second mounting portion may include a first upper through hole 156 alone. In this case, the first upper through hole 156 is formed through the first support member 15. Alternatively, the second mounting portion may include a second upper through hole 158 formed through the first support member 15 in addition to the first upper through hole 156.

When the first mounting portion includes the first lower through hole 152 alone, and the second mounting portion includes the first upper through hole 156 alone, the drum support unit 9 may include first shafts 91 respectively fittable in the first lower through hole 152 and the first upper through hole 156, and first rollers 93 rotatably coupled to respective first shafts 91 and configured to contact the circumferential surface of the drum body 31.

On the other hand, when the first mounting portion includes both the first lower through hole 152 and the second lower through hole 154, and the second mounting portion includes both the first upper through hole 156 and the second upper through hole 158, the drum support unit 9 may further include second shafts 92 respectively fittable in the second lower through hole 154 and the second upper through hole 158, and second rollers 94 rotatably coupled to respective second shafts 92 and configured to contact the circumferential surface of the drum body 31, in addition to the first shafts 91 and the first rollers 93.

As described above, each first roller 93 is rotatably coupled to the associated first shaft 91 and configured to contact the circumferential surface of the drum body 31. In addition, each second roller 94 is rotatably coupled to the associated second shaft 92 and configured to contact the circumferential surface of the drum body 31.

The first and second shafts 91 and 92 are configured to be fittable in associated ones of the first and second lower through holes 152 and 154 and the first and second upper through holes 156 and 158, respectively. Thus, the first and second shafts 91 and 92 may be mounted in either the first and second lower through holes 152 and 154 or the first and second upper through holes 156 and 158, respectively, in accordance with selection of the user.

The laundry treatment apparatus 100 having the above-described configuration has an effect capable of stably supporting the drum body 31 even in the case in which the laundry treatment apparatus 100 is installed in a vertically overturned state, because the user can change position of the drum support unit 9.

That is, when the user desires to use the laundry treatment apparatus 100 according to the embodiment of the present invention under the condition that the laundry treatment apparatus 100 is installed on the top of another laundry treatment apparatus 200 in an upside-down state, as illustrated in FIG. 4, there is no problem in use even if the first and second rollers 93 and 94 are mounted to the first and second lower through holes 152 and 154, respectively, as illustrated in FIG. 3. This is because the user can shift the first and second rollers 93 and 94 to the first and second upper through holes 156 and 158, respectively, in this case.

As described above, the front panel 14 provided in accordance with the embodiment of the present invention is separable from the body 11 of the cabinet. Accordingly, shifting of the first and second rollers 93 and 94 from the first mounting portion to the second mounting portion may be easily conducted not only by the manufacturer of the laundry treatment apparatus, but also by the user of the laundry treatment apparatus.

In order to allow the user to more easily conduct shifting, namely, position change, of the first and second rollers 93 and 94, the drum support unit 9 may have a configuration as illustrated in FIG. 3. That is, each first shaft 91 may include a first shaft body 911, a first roller coupling portion 913 provided at the first shaft body 911 and coupled to a rotation center of the associated first roller 93, a first fastening portion 915 provided at the first shaft body 911 and configured to allow a nut 95 to be fastened thereto, and a first rotation preventing portion 917 disposed between the first roller coupling portion 913 and the first fastening portion 915 and configured to have a polygonal cross-section.

In addition, each second shaft 92 may include a second shaft body 921, a second roller coupling portion 923 provided at the second shaft body 921 and coupled to a rotation center of the associated second roller 94, a second fastening portion 925 provided at the second shaft body 921 and configured to allow another nut 95 to be fastened thereto, and a second rotation preventing portion 927 disposed between the second roller coupling portion 923 and the second fastening portion 925 and configured to have the same cross-sectional shape as the first rotation preventing portion 917.

In this case, the first lower through hole 152, the second lower through hole 154, the first upper through hole 156 and the second upper through hole 158 should have the same cross-sectional shape as the first rotation preventing portion 917 (the second rotation preventing portion 927).

When the drum support unit 9 having the above-described configuration is provided at the laundry treatment apparatus 100, the user can separate or couple the nuts 95 from or to the shaft bodies 911 and 921 without holding heads of the first and second shaft bodies 911 and 921 not to rotate. Accordingly, the user may more easily change positions of the first and second rollers 93 and 94.

Meanwhile, positions of the first and second upper through holes 156 and 158 may be determined such that the first and second rollers 93 and 94 are disposed at two corners formed at an upper space of the body 11, respectively, in order to minimize height increase of the cabinet 1 resulting from provision of the first and second upper through holes 156 and 158. To attain the same effect as described above, positions of the first and second lower through holes 152 and 154 may be determined such that at least one of the first and second rollers 93 and 94 is disposed at a corner formed in a lower space of the body 11.

In addition, the belt 57 may be installed such that a tensile force F applied to the drum body 31 by the belt 57 is directed to a space defined between the first lower through hole 152 and the second lower through hole 154. In this case, the drum body 31 may be maintained in close contact with the first and second rollers 93 and 94 under the condition that the laundry treatment apparatus 100 is not in a vertically overturned state (FIG. 3).

On the other hand, the first and second mounting portions may be provided at the second support member 17. In this case, the rear surface of the body 11 should be open, and the rear panel 114 should be separably coupled to the open rear surface of the body 11. The front panel 14 provided with the cabinet opening 141 may be separably coupled to the body 11. Alternatively, the front panel 14 may be integrated with the side panels 113 while forming the front surface of the body 11.

Meanwhile, the first mounting portion may include only a first lower through hole 152 provided at a lower region of the second support member 17 (a region disposed below the horizontal line passing through the rotation center of the drum body). In addition, the second mounting portion may include only a first upper through hole 156 provided at an upper region of the second support member 17.

Alternatively, the first mounting portion may include a second lower through hole 154 provided at the lower region of the second support member 17 in addition to the first lower through hole 152. In addition, the second mounting portion may include a second upper through hole 158 provided at the upper region of the second support member 17 in addition to the first upper through hole 156.

Even when the first and second mounting portions are provided at the second support member 17, the configuration of the drum support unit 9 is the same as described above and, as such, no description as to a detailed configuration of the drum support unit 9 will be given.

As apparent from the above description, in accordance with the present invention, a laundry treatment apparatus capable of changing positions of rollers configured to rotatably support a drum may be provided. Accordingly, the present invention provides an effect of preventing downward bending of the drum and durability degradation of other constituent elements when the laundry treatment apparatus is installed upside down, through position change of the rollers.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A laundry treatment apparatus comprising:

a cabinet that defines a cabinet opening for loading and unloading of laundry;

a drum that is installed in the cabinet, that has a cylindrical shape, that is open at a front drum surface oriented toward the cabinet opening, and that is open at a rear drum surface opposite of the front drum surface;

a first support member installed in the cabinet and configured to rotatably support the front drum surface, the first support member defining a support opening configured to allow the drum to communicate with the cabinet opening through the first support member;

a second support member installed in the cabinet and configured to rotatably support the rear drum surface;

a driving unit configured to rotate the drum;

a first mounting portion provided at one of the first and second support members and located below a horizontal line passing through a rotation center of the drum;

a second mounting portion provided at the one of the first and second support members provided with the first mounting portion and located above the horizontal line passing through the rotation center of the drum; and a drum support unit configured to rotatably support a circumferential surface of the drum and configured to couple to either the first mounting portion or the second mounting portion, the drum support unit being interchangeable between coupling to the first mounting portion or the second mounting portion.

2. The laundry treatment apparatus according to claim 1, wherein:

the cabinet comprises a body having an open front surface, and a front panel attached to the front surface of the body, the front panel defining the cabinet opening; and the first mounting portion and the second mounting portion are provided at the first support member.

3. The laundry treatment apparatus according to claim 2, wherein:

the first mounting portion comprises a first lower through hole defined through the first support member;

the second mounting portion comprises a first upper through hole defined through the first support member; and the drum support unit comprises first shafts configured to respectively fit in the first lower through hole and the first upper through hole, and first rollers rotatably coupled to respective first shafts and configured to contact the circumferential surface of the drum.

4. The laundry treatment apparatus according to claim 2, wherein:

the first mounting portion comprises a first lower through hole defined through the first support member, and a second lower through hole defined through the first support member;

the second mounting portion comprises a first upper through hole defined through the first support member, and a second upper through hole defined through the first support member; and the drum support unit comprises first shafts configured to respectively fit in the first lower through hole and the first upper through hole, second shafts configured to respectively fit in the second lower through hole and the second upper through hole, first rollers rotatably coupled to respective first shafts and configured to contact the circumferential surface of the drum, and second rollers rotatably coupled to respective second shafts and configured to contact the circumferential surface of the drum.

5. The laundry treatment apparatus according to claim 4, wherein the first and second upper through holes are positioned such that the first and second rollers are disposed at two corners of an upper space of the body, respectively.

6. The laundry treatment apparatus according to claim 4, wherein the first and second lower through holes are positioned such that at least one of the first and second rollers is disposed at a corner of a lower space of the body.

7. The laundry treatment apparatus according to claim 4, wherein:

each of the first shafts comprises a first shaft body having a first roller coupling portion coupled to a rotation center of an associated one of the first rollers, and a first fastening portion configured to allow a nut to be fastened thereto, and a first rotation blocking portion that is located between the first roller coupling portion and the first fastening portion and that has a polygonal cross-section;

each of the second shafts comprises a second shaft body having a second roller coupling portion coupled to a rotation center of an associated one of the second rollers, and a second fastening portion configured to allow a nut to be fastened thereto, and a second rotation blocking portion that is located between the second roller coupling portion and the second fastening portion and that has the same cross-sectional shape as the first rotation blocking portion; and the first lower through hole, the second lower through hole, the first upper through hole, and the second upper through hole have the same cross-sectional shape as the first rotation blocking portion.

8. The laundry treatment apparatus according to claim 7, wherein the driving unit comprises a motor having a rotational shaft, and a belt configured to connect the circumferential surface of the drum to the rotational shaft, the belt being installed to apply tensile force to the drum at a space between the first lower through hole and the second lower through hole.

9. The laundry treatment apparatus according to claim 5, wherein:

each of the first shafts comprises a first shaft body having a first roller coupling portion coupled to a rotation center of an associated one of the first rollers, and a first fastening portion configured to allow a nut to be fastened thereto, and a first rotation blocking portion that is located between the first roller coupling portion and the first fastening portion and that has a polygonal cross-section;

each of the second shafts comprises a second shaft body having a second roller coupling portion coupled to a rotation center of an associated one of the second rollers, and a second fastening portion configured to allow a nut to be fastened thereto, and a second rotation blocking portion that is located between the second roller coupling portion and the second fastening portion and that has the same cross-sectional shape as the first rotation blocking portion; and the first lower through hole, the second lower through hole, the first upper through hole, and the second upper through hole have the same cross-sectional shape as the first rotation blocking portion.

10. The laundry treatment apparatus according to claim 9, wherein the driving unit comprises a motor having a rotational shaft, and a belt configured to connect the circumferential surface of the drum to the rotational shaft, the belt being installed to apply tensile force to the drum at a space between the first lower through hole and the second lower through hole.

11. The laundry treatment apparatus according to claim 6, wherein:

each of the first shafts comprises a first shaft body having a first roller coupling portion coupled to a rotation center of an associated one of the first rollers, and a first fastening portion configured to allow a nut to be fastened thereto, and a first rotation blocking portion that is located between the first roller coupling portion and the first fastening portion and that has a polygonal cross-section;

each of the second shafts comprises a second shaft body having a second roller coupling portion coupled to a rotation center of an associated one of the second rollers, and a second fastening portion configured to allow a nut to be fastened thereto, and a second rotation blocking portion that is located between the second roller coupling portion and the second fastening portion and that has the same cross-sectional shape as the first rotation blocking portion; and the first lower through hole, the second lower through hole, the first upper through hole, and the second upper through hole have the same cross-sectional shape as the first rotation blocking portion.

12. The laundry treatment apparatus according to claim 11, wherein the driving unit comprises a motor having a rotational shaft, and a belt configured to connect the circumferential surface of the drum to the rotational shaft, the belt being installed to apply tensile force to the drum at a space between the first lower through hole and the second lower through hole.

13. The laundry treatment apparatus according to claim 1, wherein:

the cabinet comprises a body having an open rear surface and an open front surface that defines the cabinet opening, and a rear panel attached to the rear surface; and the first mounting portion and the second mounting portion are provided at the second support member.

14. The laundry treatment apparatus according to claim 13, wherein:

the first mounting portion comprises a first lower through hole defined through the second support member, and a second lower through hole defined through the second support member;

the second mounting portion comprises a first upper through hole defined through the second support member, and a second upper through hole defined through the second support member; and the drum support unit comprises first shafts configured to respectively fit in the first lower through hole and the first upper through hole, second shafts configured to respectively fit in the second lower through hole and the second upper through hole, first rollers rotatably coupled to respective first shafts and configured to contact the circumferential surface of the drum, and second rollers rotatably coupled to respective second shafts and configured to contact the circumferential surface of the drum.

15. The laundry treatment apparatus according to claim 14, wherein:

each of the first shafts comprises a first shaft body having a first roller coupling portion coupled to a rotation center of an associated one of the first rollers, and a first fastening portion configured to allow a nut to be fastened thereto, and a first rotation blocking portion that is located between the first roller coupling portion and the first fastening portion and that has a polygonal cross-section;

each of the second shafts comprises a second shaft body having a second roller coupling portion coupled to a rotation center of an associated one of the second rollers, and a second fastening portion configured to allow a nut to be fastened thereto, and a second rotation blocking portion that is located between the second roller coupling portion and the second fastening portion and that has the same cross-sectional shape as the first rotation blocking portion; and the first lower through hole, the second lower through hole, the first upper through hole, and the second upper through hole have the same cross-sectional shape as the first rotation blocking portion.

16. The laundry treatment apparatus according to claim 15, wherein the driving unit comprises a motor having a rotational shaft, and a belt configured to connect the circumferential surface of the drum to the rotational shaft, the belt being installed to apply tensile force to the drum at a space defined between the first lower through hole and the second lower through hole.

17. The laundry treatment apparatus according to claim 1:

wherein the first mounting portion is provided at the first support member and located below the horizontal line passing through the rotation center of the drum; and wherein the second mounting portion is provided at the first support member and located above the horizontal line passing through the rotation center of the drum.

18. The laundry treatment apparatus according to claim 1:

wherein the first mounting portion is provided at the second support member and located below the horizontal line passing through the rotation center of the drum; and wherein the second mounting portion is provided at the second support member and located above the horizontal line passing through the rotation center of the drum.

19. The laundry treatment apparatus according to claim 1, wherein the driving unit comprises a motor having a rotational shaft, and a belt configured to connect the circumferential surface of the drum to the rotational shaft, the belt being installed to apply tensile force to the drum at a space defined between the first mounting portion and the second mounting portion.

20. The laundry treatment apparatus according to claim 1, further comprising rollers that are rotatably coupled to the drum support unit and that are configured to contact the circumferential surface of the drum.

* * * * *